US005212853A

United States Patent [19]

Kaneko

[11] Patent Number: 5,212,853

[45] Date of Patent: May 25, 1993

[54] SEPARABLE PLASTIC FASTENER AND METHOD AND APPARATUS FOR MANUFACTURING THEREOF

[75] Inventor: Yoshio Kaneko, Yokohama, Japan

[73] Assignee: Nifco Inc., Yokohama, Japan

[21] Appl. No.: 847,270

[22] Filed: Mar. 10, 1992

[51] Int. Cl.[5] ..... A44B 18/00

[52] U.S. Cl. ..... 24/452; 24/306; 24/442

[58] Field of Search ..... 24/452, 451, 450, 449, 24/448, 447, 446, 445, 444, 443, 442, 306

[56] References Cited

U.S. PATENT DOCUMENTS

| | | | |
|---|---|---|---|
| 2,499,898 | 3/1950 | Anderson . | |
| 2,717,437 | 9/1955 | de Mestral . | |
| 3,130,111 | 4/1964 | Izumi . | |
| 3,192,589 | 7/1965 | Pearson . | |
| 3,266,113 | 8/1966 | Flanagan, Jr. | 24/452 |
| 3,408,705 | 11/1968 | Kayser et al. . | |
| 3,471,903 | 10/1969 | Northrup et al. | 24/306 |
| 3,526,867 | 9/1970 | Keeler, II | 24/442 |
| 3,708,833 | 1/1973 | Ribich et al. | 24/450 |
| 3,913,183 | 10/1975 | Brumlik | 24/447 |
| 4,307,493 | 12/1981 | Ochiai | 24/450 |
| 4,330,907 | 5/1982 | Ochiai | 24/445 |
| 5,067,210 | 11/1991 | Kayaki | 24/452 |
| 5,077,870 | 1/1992 | Melbye et al. | 24/452 |

*Primary Examiner*—Victor N. Sakran

*Attorney, Agent, or Firm*—Oblon, Spivak, McClelland, Maier & Neustadt

[57] ABSTRACT

A separable fastener includes a pair of fastener pieces. Each of the fastener pieces includes a flat base and a plurality of elastic engagement projections provided on and integral with the base and arranged in a plurality of lateral and longitudinal rows. The engagement projections have respective heads of a uniform size. Each of the heads is supported on the base via a pair of leg pieces united at the upper end to opposed edge portions of the bottom of the head.

5 Claims, 13 Drawing Sheets

SEPARABLE PLASTIC FASTENER AND METHOD AND APPARATUS FOR MANUFACTURING THEREOF

BACKGROUND OF THE INVENTION

1. Field of the Invention

This invention relates to a separable plastic fastener and, more particularly, to a separable plastic fastener which comprises two fastener pieces each including a base and a plurality of elastic engagement projections which project from the base, which fastener are arranged in a plurality of lateral and longitudinal rows and have heads of the same size and leg means, and to a method and an apparatus for manufacturing the separable plastic fastener.

2. Description of the Prior Art

A typical prior art separable fastener comprises two fastener pieces, one of which has a base and a plurality of J-shaped hooks provided densely on the base, and the other one of which has a base and a plurality of loops provided densely on the base. The two fastener pieces are fastened together by pressing them together so as to cause engagement of the hooks in the loops. However, this fastener requires two kinds of fastener pieces and an improved fastener has been proposed, which comprises two fastener pieces of the same kind having a base and a plurality of hooks and loops provided alternately and densely on the base (as disclosed in U.S. Pat. Nos. 2,717,437 and 3,130,111).

In the above prior art fasteners, thread-like loops are formed densely on the base. In addition, some of the loops are cut to form the hooks, thus requiring an additional step of manufacture.

In another well-known separable plastic fastener, elastic engagement projections are densely provided on a base in a plurality of lateral and longitudinal rows (as disclosed in U.S. Pat. Nos. 2,499,898, 3,192,589 and 3,408,705). In this kind of fastener, each engagement projection has a single leg projecting from the base and a head supported on top of the leg. The head is circular or polygonal in plan view and has a spherical, hemispherical, conical or umbrella-like profile. To fasten two fastener pieces together, they are pressed against each other with their surfaces provided with the engagement projections opposed. At this time, the head of each engagement projection of one of the fastener pieces is snap-engaged in a space between adjacent engagement projections of the other fastener piece. Thus, the bottom edges of the heads of one of the fastener pieces are hooked by those of the other fastener piece, and thus the two fastener pieces are fastened together. At this time, each head having its bottom center united to the top of a single leg can be tilted in any direction, and also the single leg itself can be flexed in any direction about its lower end united to the base. Therefore, when a force tending to unfasten the fastener pieces is applied to either of the fastened fastener pieces in any direction, the head of each engagement projection having snap-engaged in a space defined by adjacent engagement projections of the other fastener piece is tilted, and the single leg integral with the head is flexed. Thus, each engagement projection of either fastener piece can be readily detached from the space defined by adjacent engagement projections of the other fastener piece. In other words, this type of fastener provides low engagement maintaining force between the two fastener pieces. In addition, when either fastener piece is unfastened from the other fastener piece, the heads of each are liable to be broken off the top of the associated single leg.

Further, when each engagement projection of either fastener piece is thrust into the space between adjacent engagement projections of the other fastener piece, the head is shaken and tilted while the associated single leg is flexed. Therefore, attainment of the snap-engagement of the bottom edge portions of the engagement projection heads of the two fastener pieces pressed against each other is hard for the user to sense tactility.

Still further, with the fastener of this type the length of the leg (strictly speaking the height from the top surface of the base to the bottom of the head) is set to be greater than the height of the head from the bottom to the top thereof in order to make the leg highly flexible to thereby reduce the force of fastening the two fastener pieces resulting from the engagement of the projection head bottoms thereof or the force of unfastening the fastener pieces, i.e., the force applied thereto for pulling them apart. However, this will allow relative movement of the two bases to an extent proportional to the difference between the length of the leg of the engagement projection and the height of the head, thus permitting joggling.

Moreover, the single leg of each of the engagement projections integral with the flat base has its top united to the center of the head bottom. Therefore, the fastener cannot be injection molded with a two-piece mold having a male and a female die because the leg has its top shielded by the head and its bottom shielded by the base. This means that it is necessary to injection mold a plastic flat base having a plurality of integral eventual legs and form heads one by one by thermally fusing and deforming a top portion of each eventual leg. This requires much time and labor. In addition, the individual heads each formed by thermally deforming a top portion of each eventual leg are not uniform. It is thus difficult to obtain products uniform in the force of engagement in the fastened state.

SUMMARY OF THE INVENTION

An object of the invention is to provide a separable fastener in which each engagement projection has a less shaky leg section, thus providing an increased force for maintaining the engagement, i.e., the fastened state.

Another object of the invention is to provide a separable fastener with which attainment of the snap-engagement of two fastener pieces can be easily sensed by the user's hands when they press the two fastener pieces against each other and also which enables the two fastener pieces to be pulled apart without breakage of the heads of the engagement projections.

A further object of the invention is to provide a separable fastener which can reduce the forces required for fastening and unfastening the two fastener pieces and is also free from joggling of the legs in the longitudinal direction thereof in the fastened state.

A still further object of the invention is to provide a method and an apparatus for manufacturing a fastener of a fastening and unfastening type, which permit highly efficient manufacture of the aforementioned separable fasteners providing uniform force to maintain the engagement, i.e., the fastened state.

According to the invention, the above objects are attained by a separable plastic fastener which comprises a pair of fastener pieces each including a flat base and a plurality of engagement projections provided on and integral with the base and arranged in a plurality of lateral and longitudinal rows, the engagement projections having heads of a uniform shape and size, the heads being supported each on the base via a pair of opposed leg pieces united at the upper ends thereof to a bottom surface edge portion of each head.

In another aspect of the separable fastener according to the invention, the base has small projections of a predetermined height provided one each at a position corresponding to the center of adjacent engagement projections in two adjacent lateral rows and two adjacent longitudinal rows.

According to the invention, there are further provided a method and an apparatus for manufacturing a separable fastener using a pair of male and female dies having respective abutment faces which abut each other in operation, the female die having a shallow recess formed in the abutment face and also having a plurality of cavities extending perpendicular to the abutment face and being open at one end to the bottom of the recess and closed at the other end, the cavities being arranged in a plurality of lateral and longitudinal rows, the male die having projections projecting from the abutment face and corresponding in number and position to the cavities of the female die, each projection having a height smaller than the distance from the abutment face of the female die to the closed end of the cavities, being snugly fitted in each cavity and having opposed side longitudinal grooves extending over the entire length of the projection, the abutment faces of the male and female dies being closed together with the projections of the male die inserted in the cavities of the female die, a molten plastic material being injected into and filling the recess of the female die and spaces defined by the cavities of the female die and the projections of the male die.

As noted above, with the fastener according to the invention the head of each engagement projection is supported on the base via a pair of opposed leg pieces and thus is less shaky. An increased force thus can be provided to maintain the engagement, i.e., the fastened state. Besides, attainment of the snap-engagement of the two fastener pieces can be sensed by the user's hands when he presses the fastener pieces. Further, the two fastener pieces can be unfastened without substantial possibility of breakage of the heads. Furthermore, by arranging the engagement projections such that a plane containing the two leg pieces of each of them is at right angles to that containing adjacent ones of them, it is possible to provide a fastener which provides uniform force to maintain the engagement in the perpendicular and lateral directions.

Further, by setting the height of the head of each engagement projection to be substantially equal to the length of the leg, it is possible to provide a fastener in which the heads are free from joggling even when a force tending to pull it apart from the fastened state is intermittently applied.

Further, by setting the length of the legs of each engagement projection so as to be greater than the height of the head and also providing the base with small projections each at a position corresponding to a space surrounded by adjacent engagement projections, the small projections having a height corresponding to the difference of the leg length from the head height, it is possible to provide a fastener which has sufficiently flexible legs. It is thus possible to reduce the force required for fastening and unfastening the fastener pieces and also eliminate joggling of the legs in the longitudinal direction thereof.

Further, by providing the head of each engagement projection with a tunnel-like cavity perpendicular to a plane containing the two leg pieces and open at the bottom and opposite sides of the head such that the head is provided with two notches by opposite end portions of the tunnel-like cavity, it is possible to provide a fastener with which the fastening force for bringing the fastener pieces into tight engagement with each other is reduced.

Further, the separable fastener according to the invention can be produced by a plastic injection molding process using a two-piece mold, i.e., a pair of male and female dies. Thus, the individual engagement projections formed on the base can have a fixed shape. It is thus possible to manufacture with high efficiency fasteners providing uniform engagement maintaining force.

The above and other objects and features of the invention will become more apparent from the following description made with reference to the accompanying drawings.

DESCRIPTION OF THE PREFERRED EMBODIMENTS

FIGS. 1 to 10 show separable fasteners according to the invention. Designated at 1 is a base, at 2 is one of a plurality of engagement projections provided in a plurality of lateral and longitudinal rows on the base 1, at 3 is a head of the engagement projection 2, and at 4 is a leg via which the head 3 is supported on the base 1. These parts are formed integrally by a plastic injection molding process and are elastic.

FIGS. 1 to 5 show an example of the engagement projection 2 on an enlarged scale, and FIGS. 6 to 10 show another example of the engagement projection 2 on an enlarged scale. The head 3 of each engagement projection 2 is elastic, umbrella-shaped in profile and circular in plan view. Its profile may instead be dome-like, flat or hemispherical, and its plan view shape may be polygonal.

Figure 11:
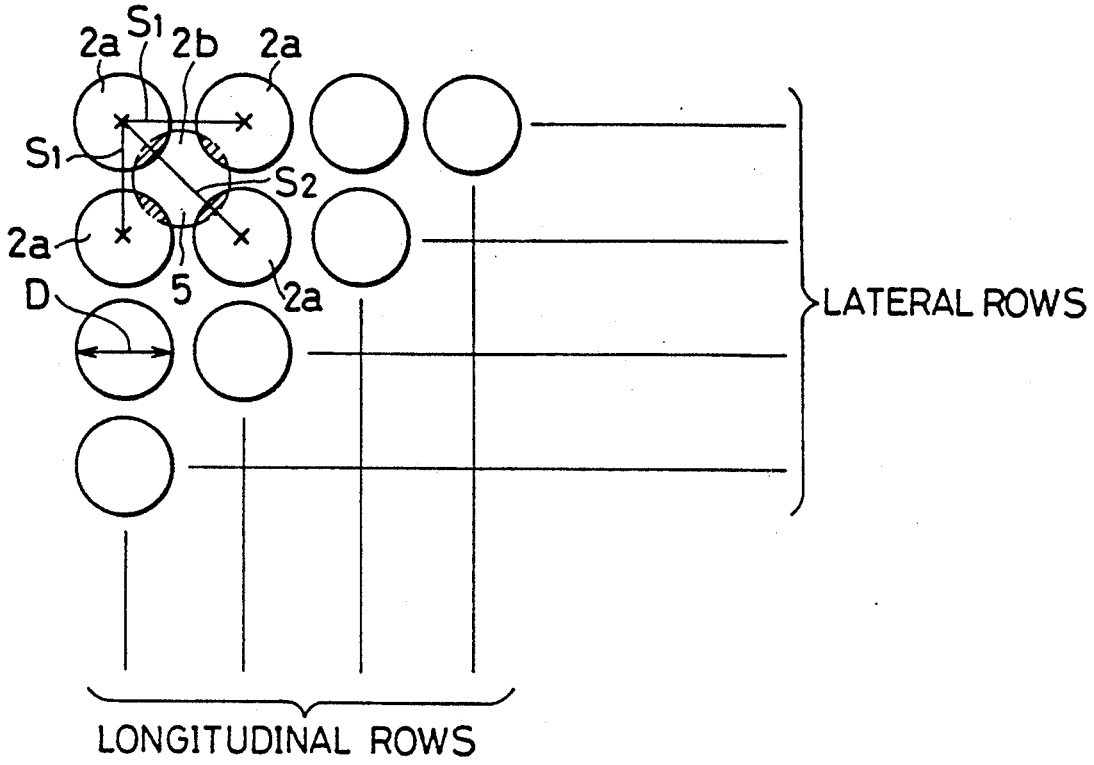
FIG. 11 is a view for explaining the distance between adjacent engagement projections of the separable fastener according to the invention arranged in lateral and longitudinal rows.

As shown in FIG. 11, a plurality of engagement projections 2*a* (2*b*) are arranged in a plurality of lateral and longitudinal rows on the base 1. When fastening two mating fastener pieces together, each engagement projection 2*b* (a representative one being shown by a broken line) of the fastener pieces is inserted with the head directed downward and deformed into a space 5 defined by four adjacent engagement projections 2*a* of the other fastener piece arranged in two adjacent lateral rows and two adjacent longitudinal rows, with the heads directed upward. Thus, the downward directed head 2*b* can interact with the shaded portions of the four upward directed heads 2*a*.

To this end, the individual engagement projections, like well-known engagement projections, are arranged so as to meet the condition $D<S_1<S_2<2D$, where D is the diameter of the head, $S_1$ is the center-to-center distance between adjacent heads in a lateral or longitudinal row, and $S_2$ is the center-to-center distance between obliquely adjacent engagement projections.

The base 1 has a hole 6 just beneath the head 3 of each engagement projection 2 in plan view. The hole 6 has substantially the same shape and size as the head 3. The leg 4 supporting the head 3 consists of a pair of leg pieces 4*a* and 4*b*. The hole 6 is formed inevitably when the fastener is injection molded using male and female dies as will be described later in detail.

Figure 1:
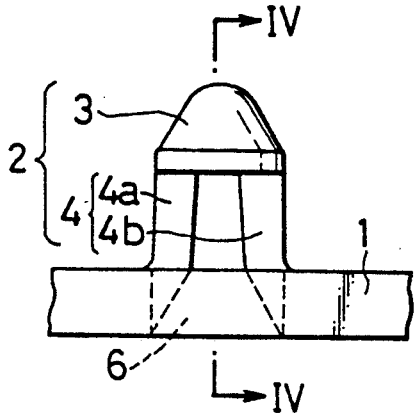
FIG. 1 is an enlarged front view showing a first example of an engagement projection of a separable fastener according to the invention.
Figure 2:
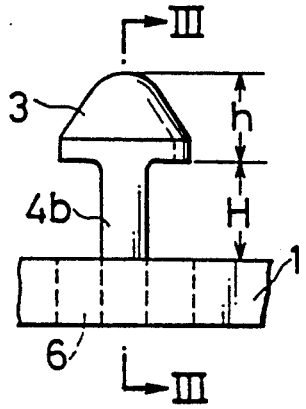
FIG. 2 is an enlarged side view of the engagement projection shown in FIG. 1.
Figure 3:
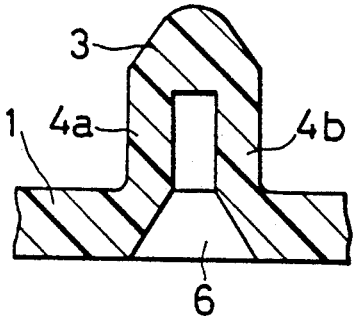
FIG. 3 is a sectional view taken along line III—III in FIG. 2.
Figure 4:
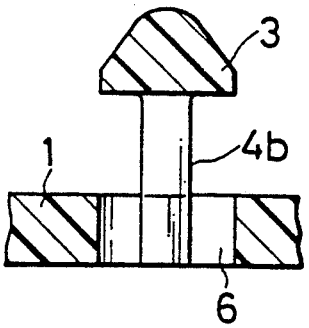
FIG. 4 is a sectional view taken along line IV—IV in FIG. 1.
Figure 5:
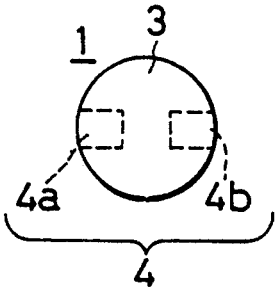
FIG. 5 is an enlarged plan view of the engagement projection shown in FIG. 1.
Figure 6:
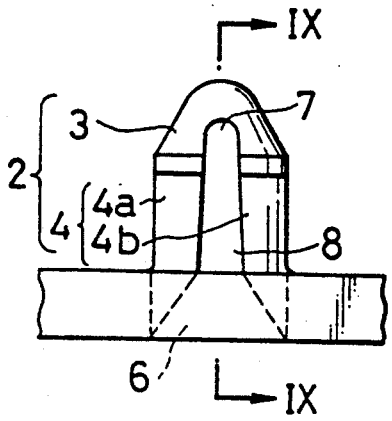
FIG. 6 is an enlarged front view showing a second example of an engagement projection of the fastener according to the invention.
Figure 7:
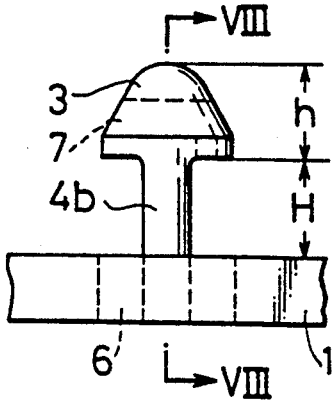
FIG. 7 is an enlarged side view of the engagement projection shown in FIG. 6.
Figure 8:
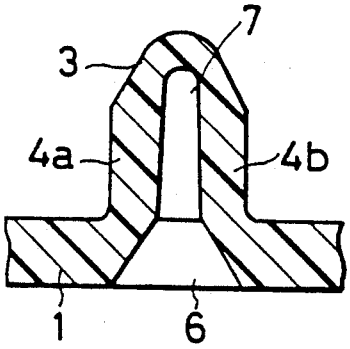
FIG. 8 is a sectional view taken along line VIII—VIII in FIG. 7.
Figure 9:
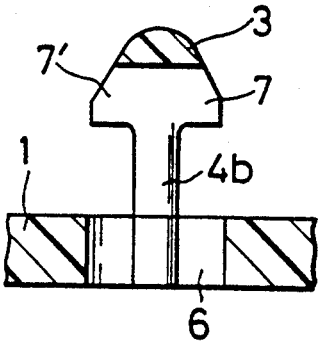
FIG. 9 is a sectional view taken along line IX—IX in FIG. 6.

The pair of leg pieces 4*a* and 4*b* are united at their top to diametrically opposed edge portions of the bottom surface of the head 3. The length of the legs 4, more accurately the height H from the top surface of the base 1 to the bottom surface of the head 3 (hereinafter referred to as the leg length) is made so as to be greater than the thickness or height (hereinafter referred to as height) h of the head 3 (FIG. 2). This is done in order to ensure that each engagement projection 2*b* of one of the two mating fastener pieces is inserted, with the head directed downward and deformed, into the space 5 centered on the intersection of the cross defined by four adjacent engagement projections 2*a* of the other fastener piece in two adjacent lateral rows and two adjacent longitudinal rows, with the heads directed upward and also that after clearing the bottoms of the four upward directed heads the downward directed head is elastically restored (the downward directed head being deformed until it clears the four upwardly directed heads and elastically restored as soon as it clears the upwardly directed heads) to partially interact with the shaded portions of the upwardly directed heads. However, the difference between the leg length H and the head height h is desirably small.

Figure 10:
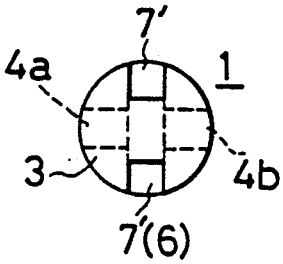
FIG. 10 is an enlarged plan view of the engagement projection shown in FIG. 6.

The head 3 of the engagement projection 2 may be solid as in the first example shown in FIGS. 1 to 5 or, as in the second example shown in FIGS. 6 to 10, be provided with a tunnel-shaped cavity 7 open at the bottom of the head and at sides at right angles to the leg pieces 4*a* and 4*b*, the cavity 7 having opposite ends defining respective notches 7' in the head 3 (FIG. 10).

Dimensionally, with a typical fastener with the base and engagement projections made of an acetal resin, the thickness of the base is 0.8 mm, the diameter of the head is 1.4 mm, the length H of the leg is 0.9 mm, the height of the head is 0.7 mm, each leg piece 4*a*, 4*b* is substantially rectangular in cross section, with a 0.5 mm long side and a 0.45 mm short side, and the distance between adjacent engagement projections arranged in lateral or longitudinal rows is 1.8 mm.

With another acetal resin fastener, the thickness of the base is 0.6 mm, the diameter of the head is 1.0 mm, the length H of leg is 0.6 mm, the height h of the head is 0.5 mm, each leg piece 4a, 4b is substantially rectangular in cross section with a long side dimension of 0.35 mm and a short side dimension of 0.3 mm, and the distance between adjacent engagement projections arranged in lateral or longitudinal rows is 1.3 mm.

The short side of each leg piece extending along the head bottom edge has an arcuate surface with the same radius of curvature as the head.

Figure 12:
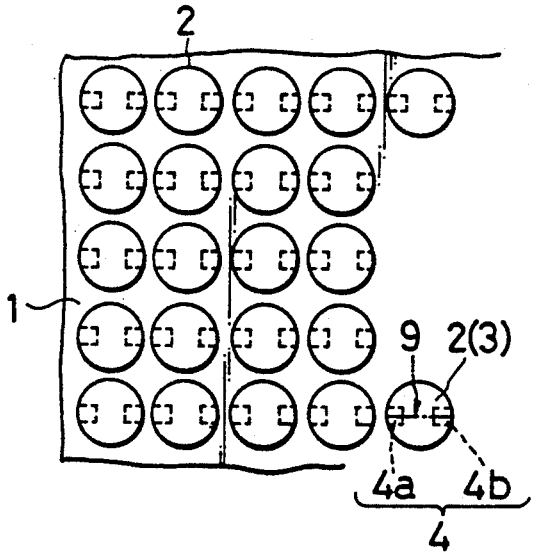
FIG. 12 is a plan view showing a first embodiment of the fastener according to the invention.

FIG. 12 shows an embodiment of the fastener. In this instance, engagement projections 2 integral with the base are such that vertical planes 9 each containing two leg pieces 4a and 4b of the leg 4 are directed in the same direction. Each engagement projection 2 has a solid head as shown in FIGS. 1 to 5.

Figure 13:
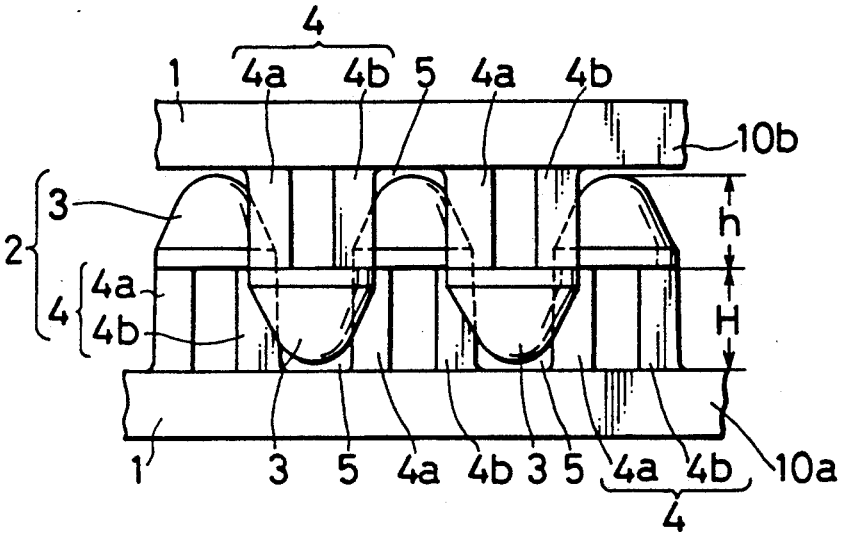
FIG. 13 is an enlarged fragmentary view showing the fastener shown in FIG. 12 in a fastened state.
Figure 14:
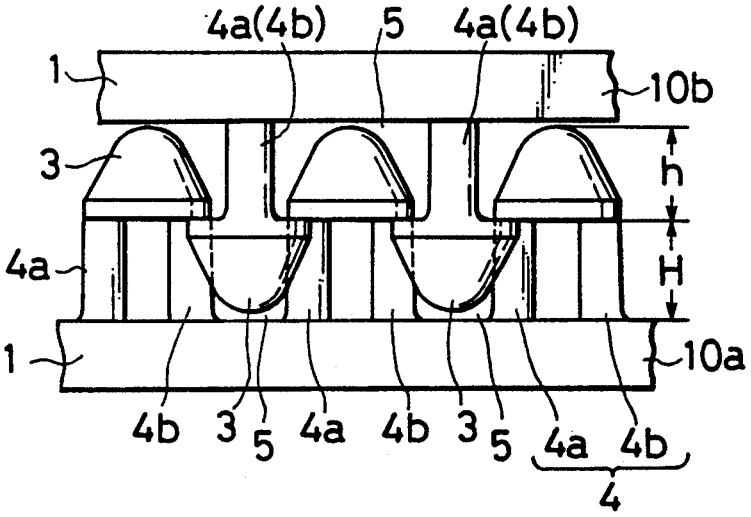
FIG. 14 is an enlarged fragmentary view of the fastener shown in FIG. 12 in a different fastened state.

When two like fastener pieces 10a and 10b formed by molding are urged against each other such that their surfaces with the engagement projections 2 oppose each other, each of the engagement projections of one of the two fastener pieces is inserted into the space 5 centered on the intersection of the cross defined by four adjacent engagement pieces of the other fastener piece, and vice versa. Thus, the bottom surfaces of the heads of the two fastener pieces are hooked to one another, and the two fastener pieces are thus fastened together (FIGS. 13 and 14). Further, as in the prior art fastener, the two fastener pieces 10a and 10b in the fastened state can be unfastened by pulling them apart.

However, since the head 3 of each engagement projection is supported on the base 1 via two opposed leg pieces 4a and 4b, it cannot be freely tilted in any direction, but can be tilted slightly at most about the upper edge of the plane 9 containing the two leg pieces. Also, the two leg pieces can be tilted at most about the lower edge of the plane 9.

Thus, when each engagement projection of one of the fastener pieces 10a and 10b is snap engaged in the space 5 centered on the intersection of the cross defined by four adjacent engagement projections of the other fastener piece, its head and two leg pieces exhibit very little shakiness. That is, the snap engagement is obtained with sole elastic deformation of the heads of five engagement projections, one being of one of the fastener pieces and the four others being of the other fastener piece. Thus, when the snap engagement is completed to effect fastening of the two fastener pieces, the restoration of the deformed heads can be easily sensed by the user's hands pressing the fastener pieces. In addition, since the head and two leg pieces of each engagement projection cannot be freely tilted in any direction, the fastened state can be maintained with a great force.

Further, when the fastened fastener pieces are pulled apart for unfastening, the head is safe from breaking off because it is supported by the two leg pieces.

FIG. 13 shows the two fastener pieces 10a and 10b fastened such that the plane 9 containing the two leg pieces of each engagement projection of one of the fastener piece 10a extends parallel to that of the other fastener piece 10b. FIG. 14 shows the two fastener pieces 10a and 10b fastened such that the plane containing the two leg pieces of each engagement piece of the fastener piece 10a extends at right angles to that of the other fastener piece 10b. With either fastened state, the same function and effects can be obtained. By setting the leg length H to be only slightly greater than the head height h as shown, it is possible to prevent vertical joggling of the head in the fastened state as shown in the Figures.

Figure 15:
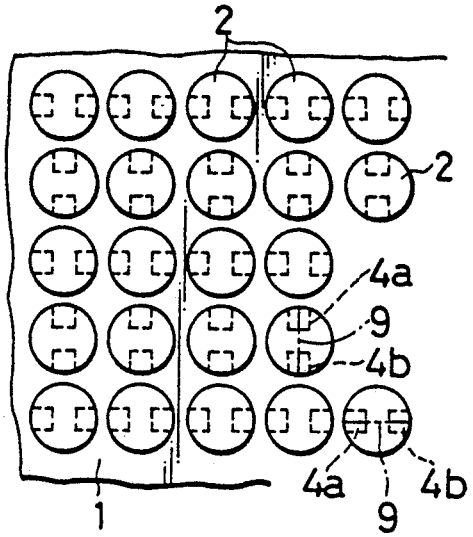
FIG. 15 is a plan view showing a second embodiment of the fastener according to the invention.

FIG. 15 shows a second embodiment of the fastener. In this embodiment, the planes 9 each containing two leg pieces of engagement projections 2 in odd lateral rows are directed in the direction of the lateral rows, while those of engagement projections 2 in even lateral rows are directed in the direction of the longitudinal rows. The remainder of the structure is like the embodiment of FIG. 12.

Thus, two fastener pieces of this embodiment can be fastened together with their surfaces with the engagement projections opposed, as in the states shown in FIGS. 13 and 14.

While in the second embodiment the engagement projections in odd lateral rows and those in even lateral rows have their leg piece-containing planes directed at right angles to one another, it is also possible for the engagement projections in odd longitudinal rows and those in even longitudinal rows to have their leg piece-containing planes directed at right angles to one another.

Figure 16:
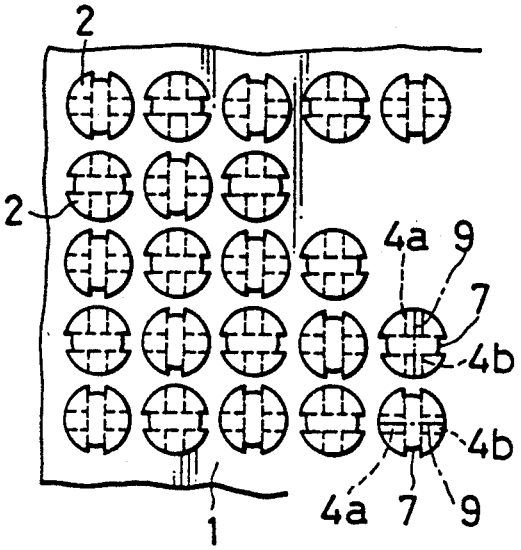
FIG. 16 is a plan view showing a third embodiment of the fastener according to the invention.

FIG. 16 shows a third embodiment. In this instance, the planes 9 containing the leg pieces 4a and 4b of adjacent engagement projections 2 are directed at right angles to one another. The engagement projection of this embodiment has a tunnel-like cavity 7 as shown in FIGS. 6 to 10. Thus, the cavity 7 of each engagement projection is in a right angle relation to that of adjacent engagement projections.

Figure 17:
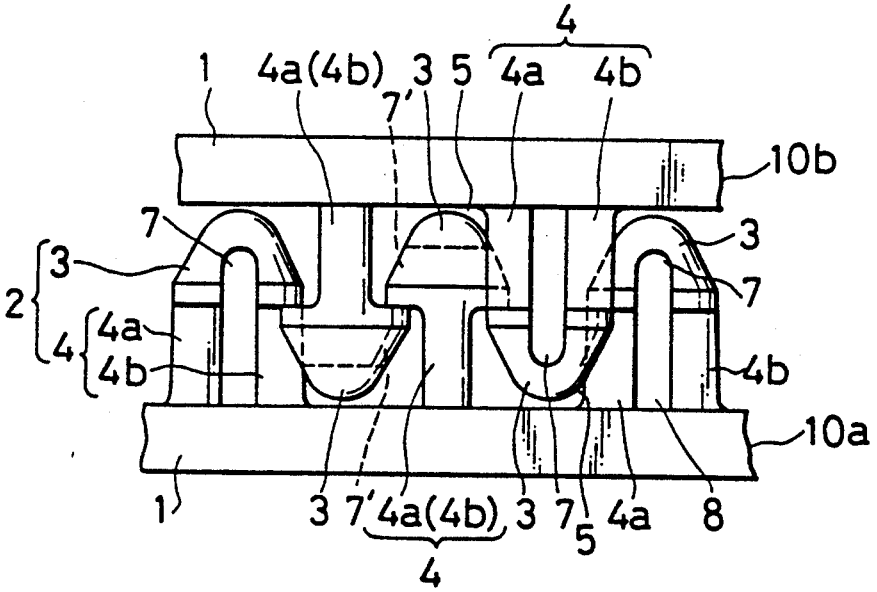
FIG. 17 is an enlarged fragmentary view of the fastener shown FIG. 16 in a fastened state.

Since in this embodiment the engagement projections 2 are arranged in the aforementioned manner, a fastened state as shown in FIG. 17 results when two fastener pieces are fastened together. This fastened state can be obtained by fastening the two fastener pieces 10a and 10b together either in the direction shown in FIG. 13 or in the direction shown in FIG. 14. This means that this fastener can provide a more stable fastened state than the fastener shown in FIG. 12 providing different fastened states as shown in FIGS. 13 and 14 depending on the direction, in which two fastener pieces are fastened together.

When the head of each engagement projection of one of the two fastener pieces is snap engaged in the space 5 centered on the intersection of the cross defined by four adjacent engagement projections of the other fastener piece in the operation of fastening together the two fastener pieces, the heads of the five engagement projections noted above are elastically deformed. In this embodiment, since the head of the engagement projection has diametrically opposed notches 7' defined by its tunnel-like cavity perpendicular to the plane 9 containing the two legs 4a and 4b, the head 3 is readily deformed. Thus, the force required to be applied to fasten together the two fastener pieces 10a and 10b can be reduced.

Of course, the engagement projections in the embodiments of FIGS. 12 and 15 may be replaced with those having the tunnel-like cavity 7. Conversely, the engagement projections in the embodiment of FIG. 16 may be replaced with those without the cavity 7 as shown in FIGS. 1 to 5.

Figure 18:
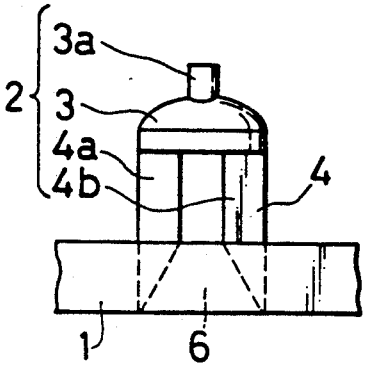
FIG. 18 is an enlarged front view showing a third example of an engagement projection of the fastener according to the invention.
Figure 19:
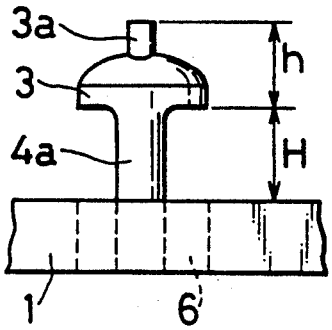
FIG. 19 is an enlarged side view of the engagement projection shown in FIG. 18.
Figure 20:
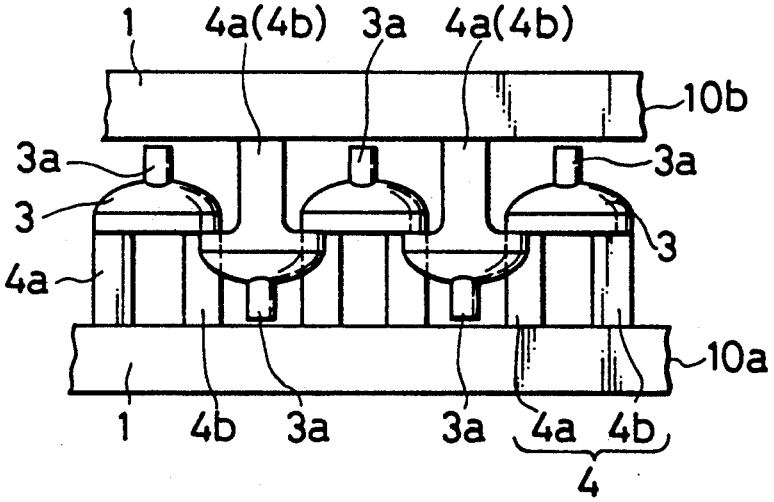
FIG. 20 is an enlarged fragmentary view showing the fastener having the engagement projections of FIG. 18 in a fastened state.

Further, as shown in FIGS. 18 and 19, the head 3 of each engagement projection 2 may have a small projection 3a projecting from its top. In this case, the leg length H is set to be slightly greater than the height h from the bottom of the head 3 to the top of the small projection 3a. With this structure, by pressing together the surfaces of two fastener pieces 10*a* and 10*b* having the engagement projections 2 each having the head 3 with the small projection 3*a*, the two fasteners are fastened as shown in FIG. 20, with bottoms of their heads engaged with one another and the free end of each small projection 3*a* of one of the fastener pieces in close proximity with the base 1 of the other fastener piece. Further, the fastened fastener pieces 10*a* and 10*b* can be unfastened by pulling them apart.

In the embodiment of FIGS. 18 and 19 the small projection 3*a* is provided on the head of the engagement projection shown in FIGS. 1 to 5, but it may also be provided on the head of the engagement projection having the tunnel-like cavity as shown in FIGS. 6 to 10.

Figure 21:
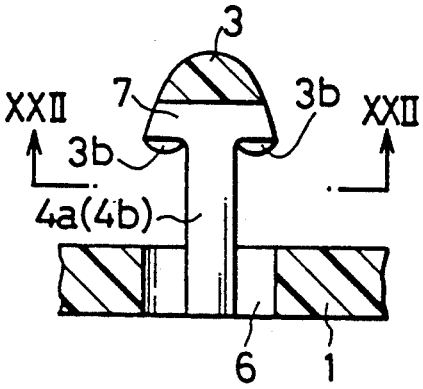
FIG. 21 is an enlarged sectional view showing a fourth example of an engagement projection of the fastener according to the invention.
Figure 22:
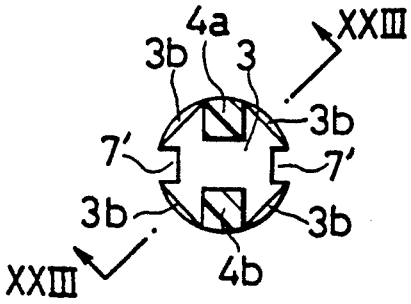
FIG. 22 is an enlarged sectional view taken along line XXII—XXI in FIG. 21.
Figure 23:
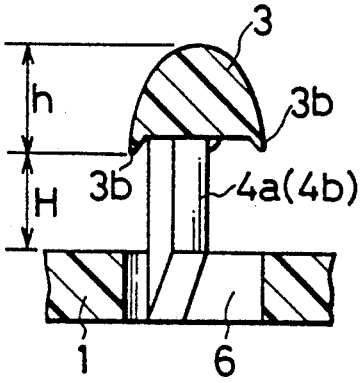
FIG. 23 is an enlarged sectional view taken along line XXIII—XXIII in FIG. 22.
Figure 24:
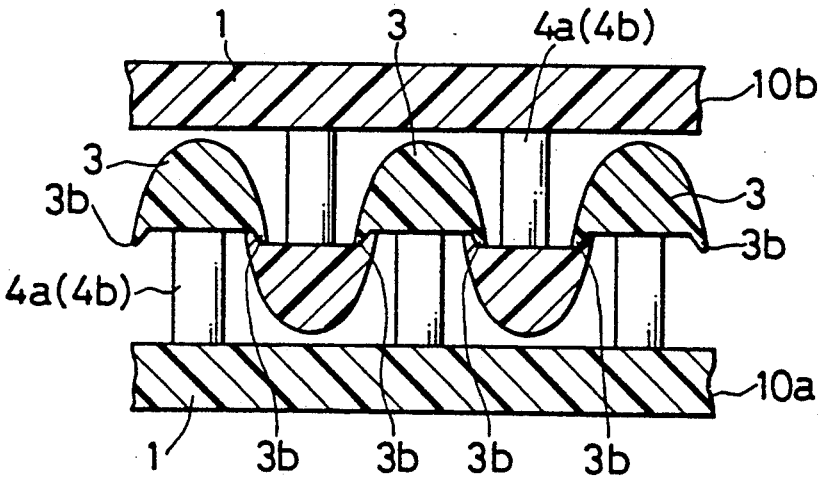
FIG. 24 is an enlarged sectional view showing the fastener having the engagement projections of FIG. 21 in a fastened state.

Further, the head 2 having the tunnel-like cavity as shown in FIGS. 6 to 10 may have wedge-like projections 3*b*, as shown in FIGS. 21 to 23, each depending from each of four arcuate edge portions of its bottom other than the notches 7' defined by opposite ends of the cavity 7 and leg pieces 4*a* and 4*b*. In this case, the length H is not the length of the leg but the height from the top of the base 1 to the free end of the wedge-like projection 3*b*. This height H is set to be slightly greater than the head height h. With this structure, by pressing together the surfaces of two fastener pieces 10*a* and 10*b* having the engagement projections each having the wedge-like projections 3*b* of the same shape, as shown in FIG. 24, the engagement projections of the two fastener pieces 10*a* and 10*b* are engaged with one another with inclined inner surfaces of the wedge-like projections 3*b* in plane contact with one another. It is thus possible to enhance the engagement maintaining force, i.e., the fastened state. The fastened fastener pieces can be unfastened by pulling them apart against the engagement maintaining force.

Figure 25:
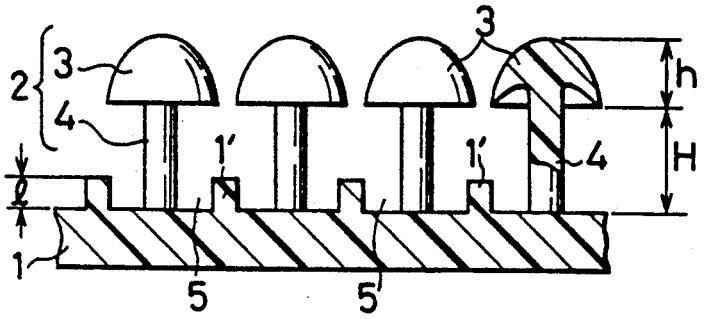
FIG. 25 is an enlarged front view, partly in section, showing a fourth embodiment of the fastener according to the invention.
Figure 26:
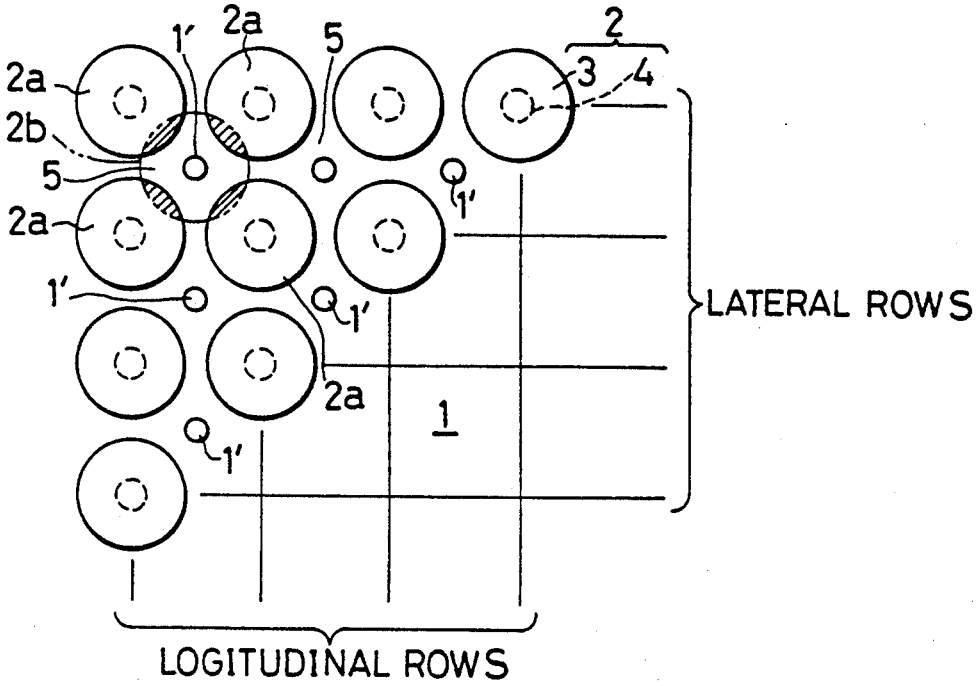
FIG. 26 is an enlarged plan view of the fastener shown in FIG. 25.
Figure 27:
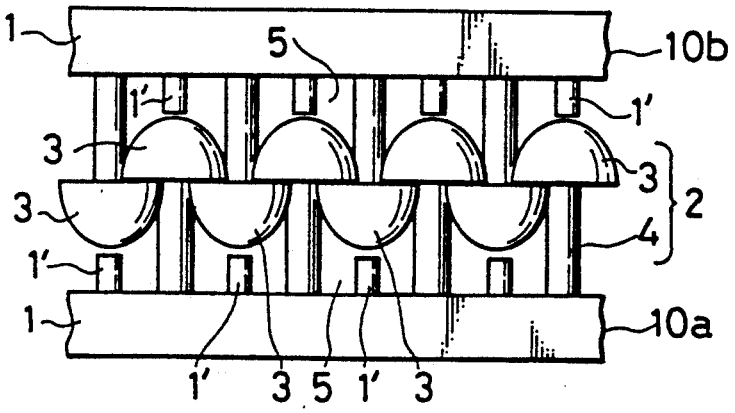
FIG. 27 is an enlarged sectional view of the fastener shown in FIG. 25 in a fastened state.

FIGS. 25 to 27 and FIGS. 28 to 31 show further embodiments of fastener, in which small projections 1' having a predetermined height l are provided on the base 1 at positions each corresponding to the space 5 surrounded by adjacent engagement projections 2 in lieu of the small projection 3*a* provided atop the head 3 of each engagement projection shown in FIGS. 18 and 19. In the instance of FIGS. 25 to 27, the head 3 of the engagement projection 2 is supported by a single leg 4. In the embodiment of FIGS. 28 to 31, the head 3 of the engagement projection 2 is supported by a leg 4 consisting of two opposed leg pieces 4*a* and 4*b* with the inner ends thereof united to the wall surface of the hole 6.

Figure 30:
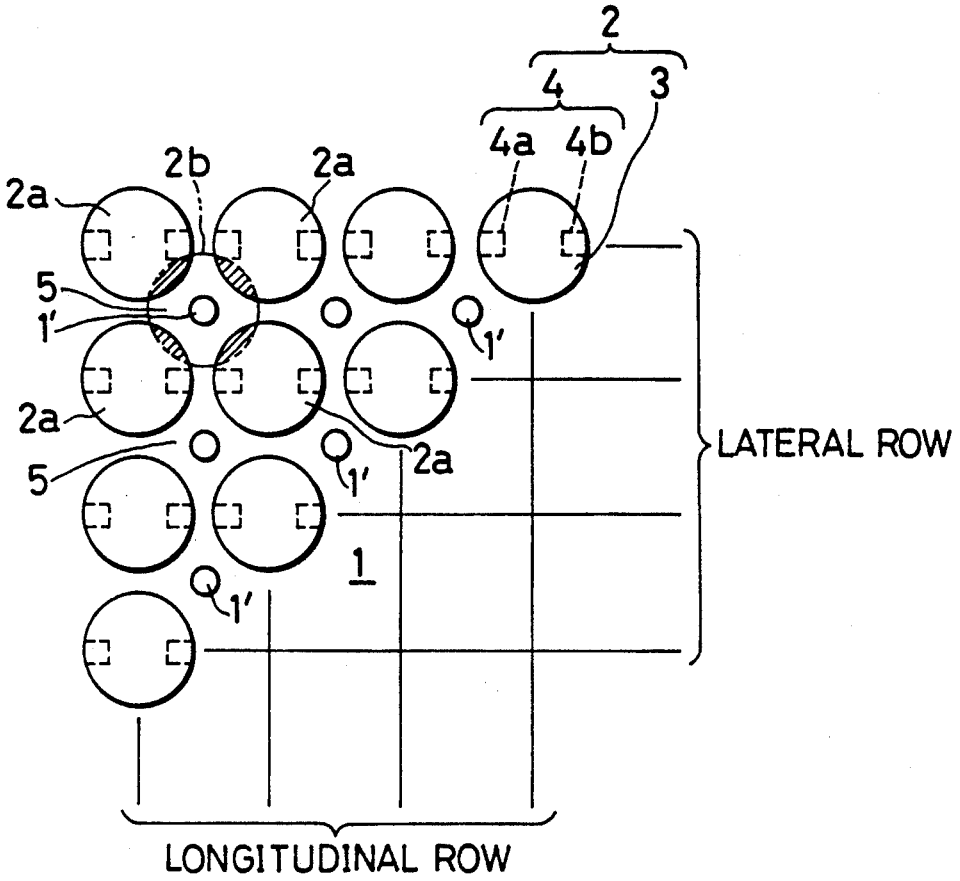
FIG. 30 is a plan view of the fastener shown in FIG. 28.

The distance between adjacent engagement projections on the base in adjacent lateral rows and adjacent longitudinal rows is like that in the instance of FIG. 11. As shown in FIGS. 26 and 30, the engagement projection 2*b* is snap engaged, with its head directed downward, in the space 5 centered on the intersection of the cross defined by four adjacent engagement projections 2*a* with the upward directed heads in two adjacent lateral rows and two adjacent longitudinal rows. The downward directed head engages the shaded portions of the four upward directed heads.

The height H from the top surface of the base 1 to the bottom of the head 3 of each engagement projection 2 is set to be greater than the height h of the head 3 from the bottom thereof. Each small projection 1' provided at the center of the space 5 between four adjacent engagement projections in two adjacent lateral rows and two adjacent longitudinal rows has a height l corresponding substantially to the difference between the two heights, i.e. H−h. The small projection 1', base 1 and engagement projections 2 are molded integrally from a plastic material.

Dimensionally, with a fastener made of an acetal resin as shown in FIGS. 25 to 27, the thickness of the base is 0.8 mm, the diameter of the head of the engagement projection is 1.4 mm, the height H from the base top to the head bottom is 0.9 mm, the height h of the head is 0.4 mm, the height l of the small projection is 0.4 mm, and the distance between adjacent engagement projections in lateral or longitudinal rows is 1.8 mm.

Figure 28:
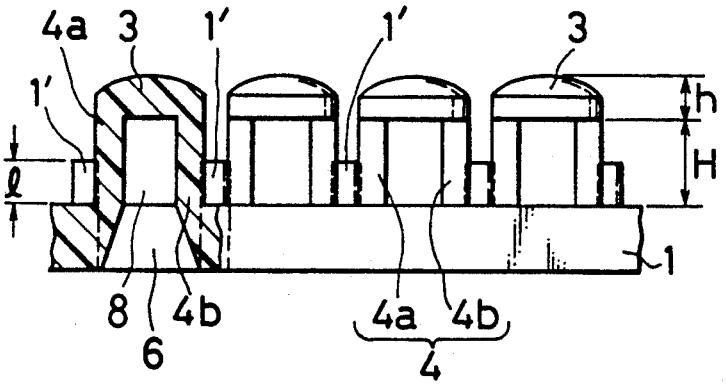
FIG. 28 is an enlarged front view, partly in section, showing a fifth embodiment of the fastener according to the invention.
Figure 29:
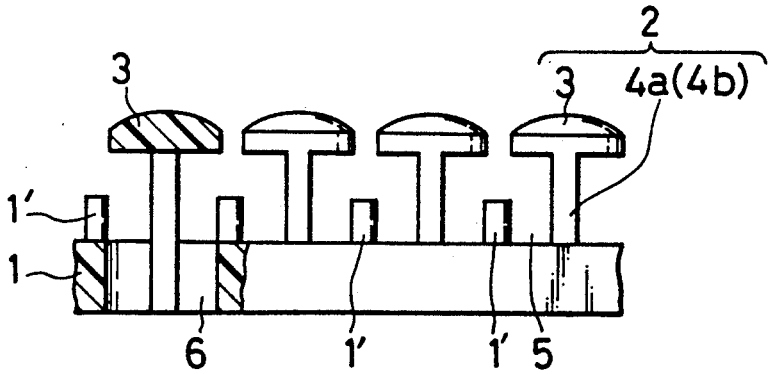
FIG. 29 is an enlarged side view, partly in section, of the fastener shown in FIG. 28.

With the fastener shown in FIGS. 28 to 30 made of the same acetal resin, the thickness of the base is 0.6 mm, the diameter of the head of the engagement projection is 1.0 mm, the height H from the base top to the head bottom is 0.8 mm, the height h of the head is 0.2 mm, the height l of the small projection is 0.5 mm, and the distance between adjacent engagement projections in lateral or longitudinal rows is 1.3 mm.

The leg 4 consists of two leg pieces 4*a* and 4*b*, the upper ends of which support diametrically opposed edge portions of the head bottom. In the front view of FIG. 28 the two leg pieces 4*a* and 4*b* are seen as such, but in the side view of FIG. 29 they are seen overlapped and look like a single leg.

Figure 31:
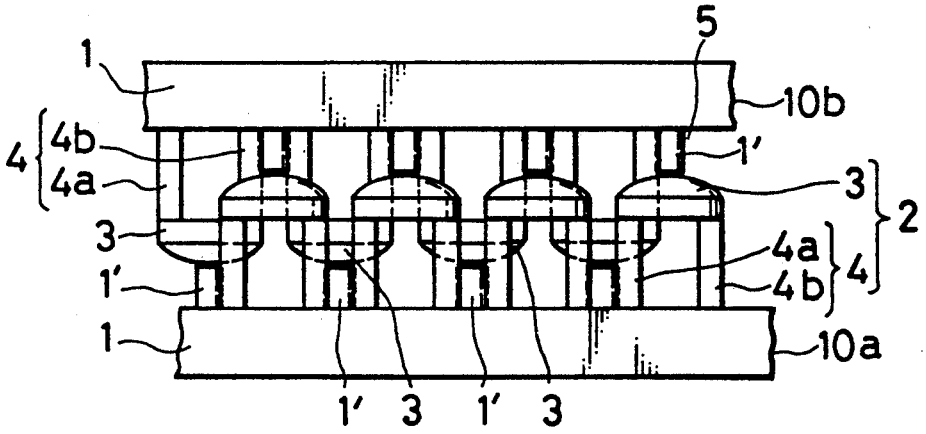
FIG. 31 is an enlarged fragmentary view of the fastener shown in FIG. 28 in a fastened state.

By pressing together two fastener pieces 10*a* and 10*b* with their surfaces having the engagement projections 2 opposed, each engagement projection 2 of one of the fastener pieces is snap engaged in the space 5 at the intersection of the cross defined by four adjacent engagement projections 2 of the other fastener piece. The two fastener pieces are fastened together with their respective head bottoms engaged with one another when the engagement projection head top of one of the fastener pieces reaches the top of the small projections 1' of the other fastener piece (FIGS. 27 and 31). The fastened fastener pieces 10*a* and 10*b* can be unfastened by pulling them apart to pull the head 3 of each engagement projection out of the space at the center of the cross noted above.

The head of each engagement projection is helmet-like in profile in the case of FIG. 25 and like a button in the case of FIG. 28. However, it may instead have any of various other profiles, for instance a hemispherical or dome-like profile. In plan view, it may be polygonal instead of circular as shown.

Further, the length or height H of the leg 4 of the engagement projection may be made greater than the height h from the head top to the head bottom by forming a concavely curved head bottom as shown in section in FIG. 25.

Figure 32:
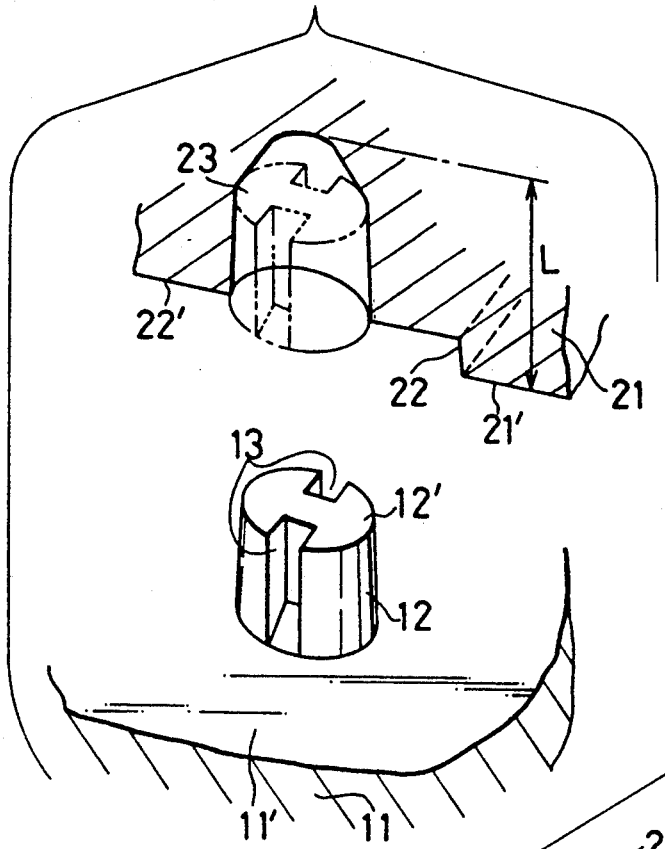
FIG. 32 is a fragmentary perspective view showing a female and a male die for molding a fastener having the engagement projection shown in FIG. 1.
Figure 33:
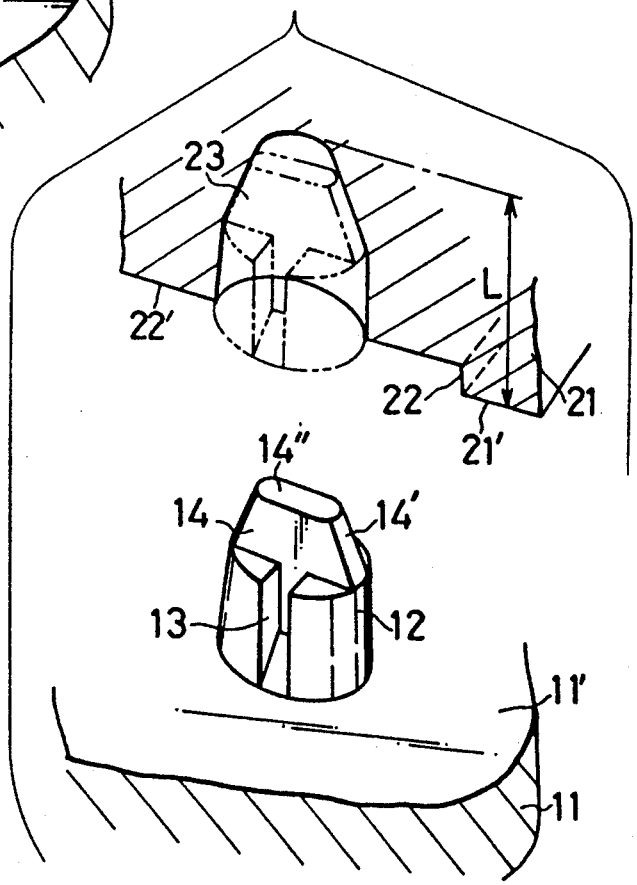
FIG. 33 is a fragmentary perspective view showing a female die and a male die for molding a fastener having the engagement projection shown in FIG. 6.

FIGS. 32 and 33 show male and female dies 11 and 21 for producing the first and second embodiments of the fasteners as moldings by injecting a plastic material into a cavity formed by closing together the mating dies. The molding can be taken out by opening the dies. By this method, the fasteners can be produced with high efficiency.

FIG. 32 shows portions of male and female dies 11 and 21 for producing the fastener having the engagement projections shown in FIGS. 1 to 5. FIG. 33 shows portions of male and female dies 11 and 21 for producing the fastener having the projections having the head with the tunnel-like cavity as shown in FIGS. 6 to 10.

The female die 21 has its abutment face 21' formed with a shallow recess 22 for forming the base. It also has a plurality of cavities 23 extending perpendicular to the abutment face 21'. These cavities are open at one end to the bottom 22' of the recess 22 and closed at the other end. They are arranged in a plurality of lateral and longitudinal rows. The distance between adjacent cavities in a lateral or longitudinal row is as described before in connection with FIG. 11. Where the engagement projection is circular in plan view and has a frustoconical, dome-like or hemispherical head, each cavity 23 is cylindrical as shown.

The male die 11 has its abutment face 11' formed with projections 12 corresponding in number and position to the cavities 23 of the female die 21. Each projection 12 has a height less than the distance L from the abutment face to the bottom of the cavity of the female die and fits snugly on the inner surface of the cavity. It has a pair of diametrically opposed longitudinal grooves 13 extending over its entire length for forming the pair of leg pieces.

Where the engagement projection shown in FIGS. 1 to 5 is formed, the projection 12 may have a flat top 12' as shown in FIG. 32. Alternatively, it may have a convexedly curved top surface for forming an engagement projection head having a concavedly curved bottom surface.

Where the engagement projection shown in FIGS. 6 to 10 is formed, the projection 12 is provided with a top ridge 14 for forming the tunnel-like cavity. Regarding the ridge 14, each edge 14' is adapted to snugly fit the female die cavity surface and the top 14" is adapted to be spaced apart from the female die cavity bottom.

The female die cavity 23 is slightly tapered toward its bottom portion and the male die projection 12 is slightly tapered toward its top portion, thus facilitating die separation.

In FIGS. 32 and 33, broken lines illustrate a state of the male and female dies with the abutment faces thereof in contact with each other and with each male die projection 12 fitted in a female die cavity 23. For injecting molten plastic material, the shallow cavity 22 provided in the female die abutment face is closed by the male die abutment face and thus forms a cavity for forming the base. In addition, a cavity for forming the head of each engagement projection is formed between the top of each male die projection 12 and the bottom portion of each female die cavity 23. The head-forming cavity is communicated with the base-forming cavity by the opposed grooves 13 provided in the male die projection. The grooves 13 are closed by the surface of the female die cavity and form cavities for forming the pair of leg pieces.

For injection molding the plastic fastener, the male and female dies are set in an injection mold, and a molten plastic material is injected from any one of the three different kinds of cavities noted above, which are communicated with one another, thus filling these cavities with the material. A fastener as shown in FIG. 12, 15 or 16 is thus obtained, which has the engagement projections integral with one side of the base as shown in FIGS. 1 to 5 or 6 to 10. It can be taken out by opening the dies 11 and 21.

The base has holes 6 formed by the male die projections 12.

Figure 34:
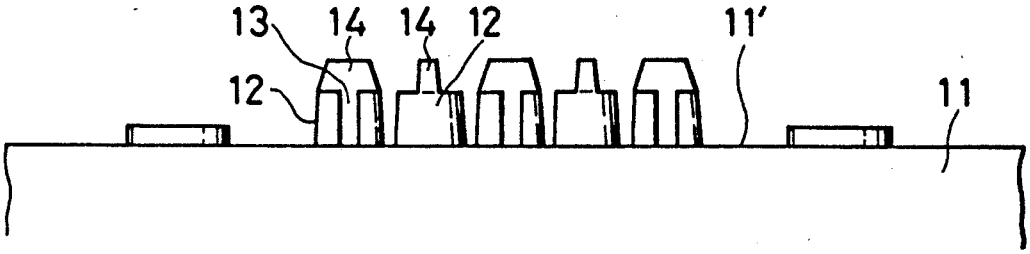
FIG. 34 is a side view showing a male die for molding the fastener shown in FIG. 16.
Figure 35:
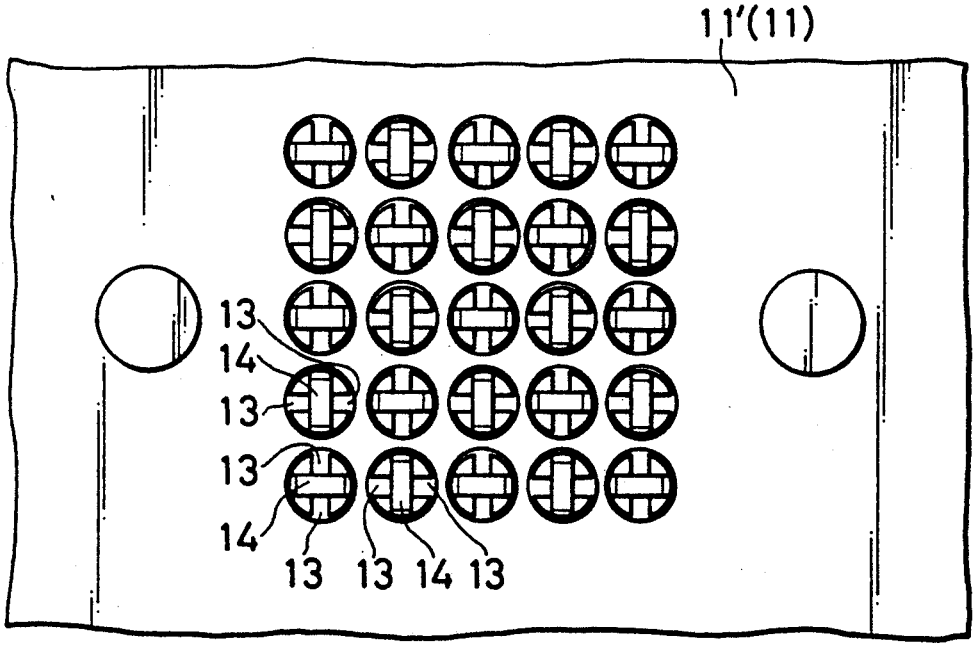
FIG. 35 is a plan view of the male die shown in FIG. 34.
Figure 36:
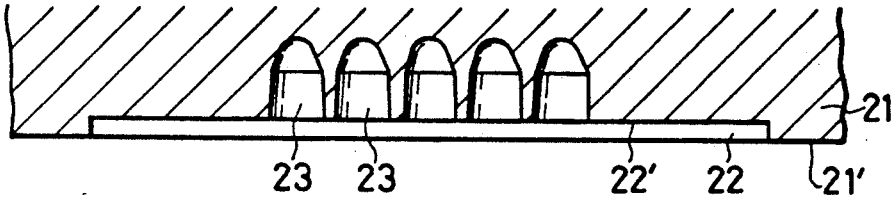
FIG. 36 is a sectional view showing a female die for molding the fastener shown in FIG. 16.
Figure 37:
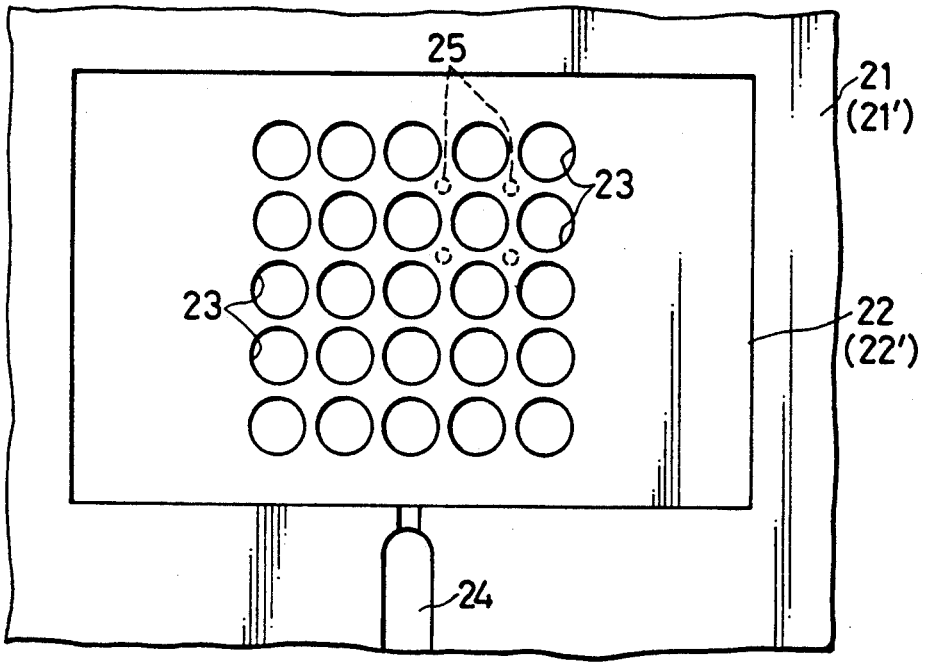
FIG. 37 is a plan view of the female die shown in FIG. 36.

FIGS. 34 and 35 show a male die 11 for forming the fastener shown in FIGS. 16 and 17, and FIGS. 36 and 37 show a female die 21 for forming the same fastener. In this case, the opposite grooves 13 and top ridge 14 of each male die projection 12 have a right angle orientation with respect to those of the adjacent projection.

Figure 38:
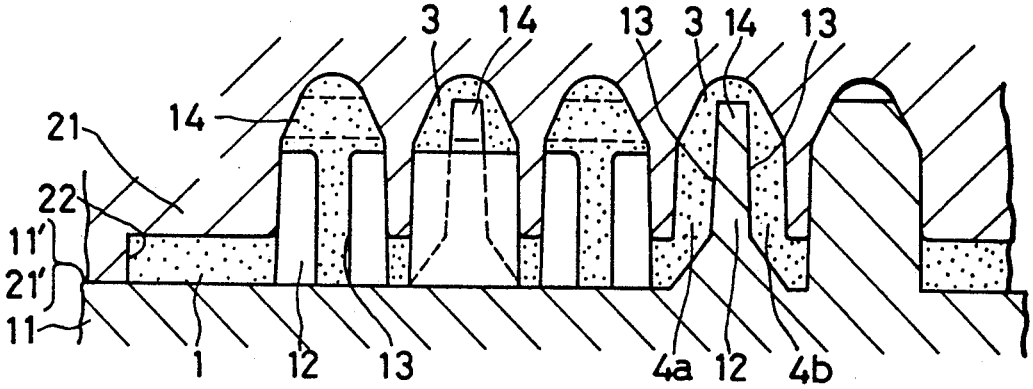
FIG. 38 is an enlarged sectional view showing how the fastener shown in FIG. 16 is injection molded using the male and female dies respectively shown in FIGS. 34 and 36.

Thus, by closing the two dies together and injecting a molten plastic material into the shallow recess 22 defining the base-forming cavity from a material injection port 24 provided in the female die, the fastener shown in FIGS. 16 and 17 can be obtained as shown in FIG. 38. This fastener can be taken out by opening the dies.

For forming the fastener shown in FIGS. 28 to 31, the female die 21 is provided in the shallow recess 22 with holes 25 (FIG. 37) of a predetermined diameter and a predetermined depth disposed one each at the center of four adjacent cavities for forming the small projections 1'. Thus, this fastener can also be produced with high efficiency using a plastic injection mold.

As has been described in the foregoing discussion, with the fastener according to the invention the head of each engagement projection is supported by the base via a pair of opposed leg pieces and is thus less shaky. As a result, a strong force of engagement can be obtained in the fastened state. In addition, the attainment of the fastened state can be sensed by the hands. Further, unfastening can be effected without breakage of the heads. Still further, with the pair of leg pieces of each engagement projection formed in a right angle orientation with respect to those of the adjacent engagement projection, the fastener can provide the same engagement force in the lateral and longitudinal directions. Still further, by providing engagement projection leg pieces having a sufficiently large length and providing small projections each disposed midway between adjacent engagement projections and having a height corresponding substantially to the difference between the leg length and the head height, it is possible to provide a fastener requiring reduced fastening and unfastening forces while maintaining firm engagement.

Furthermore, the fastener according to the invention can be produced by the plastic molding process using a two-piece mold, i.e. a male die and a female die. It is thus possible to manufacture a fastener providing uniform engagement force with high efficiency.

Obviously, numerous modifications and variations of the present invention are possible in light of the above teachings. It is therefore to be understood that within the scope of the appended claims, the invention may be practiced otherwise than as specifically described herein.

What is claimed is:

1. A separable plastic fastener which comprises:

a pair of fastener pieces each including a flat base and a plurality of engagement projections provided on and integral with said base and arranged in a plurality of lateral and longitudinal rows, said engagement projections having heads of a uniform shape and a uniform size, each of said heads being supported on said base via a pair of opposed leg pieces united at the upper end thereof to opposed bottom surface edge portions of said head wherein each of said heads of said engagement projections has a tunnel-like cavity extending perpendicularly to a plane containing and parallel to said two leg pieces and open at its bottom and opposite sides and wherein each of said heads of said engagement projections has four bottom edge portions defined by said two leg pieces and said tunnel-like cavity and formed with respective downward directed wedge-like projections.

2. A separable plastic fastener which comprises:

a pair of fastener pieces each including a flat base and a plurality of engagement projections provided on and integral with said base and arranged in a plurality of lateral and longitudinal rows, said engagement projections having heads of a uniform shape and a uniform size, each of said heads being supported on said base via a pair of opposed leg pieces united at the upper end thereof to opposed bottom surface edge portions of said head and wherein said base has small projections each projecting from a position corresponding to the center of four adjacent engagement projections in two adjacent lateral rows and two adjacent longitudinal rows, each of said small projections having a height corresponding to the difference between a height from the top of said base to the bottom of said head and a height from the bottom to the top of said head.

3. A separable plastic fastener comprising a pair of fastener pieces each including a flat base, a plurality of elastic engagement projections provided in a plurality of lateral and longitudinal rows on said base and each including a leg projecting from said base and a head supported by the distal end of said leg, and small projections each projecting from said base at a position corresponding to the center of four adjacent engagement projections in two adjacent lateral rows and two adjacent longitudinal rows, each of said small projections having a height corresponding to the difference between a height from the bottom of said head of each of said engagement projections to the top of said base and a height from the top of said head to the bottom thereof.

4. The plastic fastener according to claim 3, wherein said head of each said engagement projection is supported at the center of its bottom by the distal end of said leg.

5. The plastic fastener according to claim 3, wherein said leg comprises a pair of leg pieces and said head of each of said engagement projections is supported at its bottom edge portions by the distal ends of said pair of leg pieces.

* * * * *